United States Patent [19]

Swain et al.

[11] Patent Number: 4,481,851

[45] Date of Patent: Nov. 13, 1984

[54] TONE GENERATOR ASSIGNMENT SYSTEM FOR AN ELECTRONIC MUSICAL INSTRUMENT

[75] Inventors: Richard S. Swain, Niles; Mark Fimoff, Hoffman Estates, both of Ill.

[73] Assignee: Norlin Industries, Inc., White Plains, N.Y.

[21] Appl. No.: 275,723

[22] Filed: Jun. 22, 1981

[51] Int. Cl.[3] ..... G10H 1/18

[52] U.S. Cl. ..... 84/1.01; 84/DIG. 2

[58] Field of Search ..... 84/1.01, DIG. 2

[56] References Cited

U.S. PATENT DOCUMENTS 4,292,873 10/1981 Okumura et al. ..... 84/1.01

*Primary Examiner*—Stanley J. Witkowski

*Attorney, Agent, or Firm*—Ronald J. Kransdorf

[57] ABSTRACT

An electronic musical instrument includes a keyboard having a plurality of keys, each depressed key being identified by a uniquely developed multibit code. Each of a plurality of tone generators, substantially less in number than the number of keys characterizing the keyboard, is operable in response to each of the multibit codes for producing a tone signal having a frequency corresponding to the pitch of the associated depressed key. Each depressed key is assigned for playing through one of the tone generators by a control circuit, the control circuit being responsive to the condition wherein all of the tone generators have been assigned to previously played keys for assigning a newly played key for playing through the tone generator which was assigned to the oldest released one of the previously played keys.

12 Claims, 5 Drawing Figures

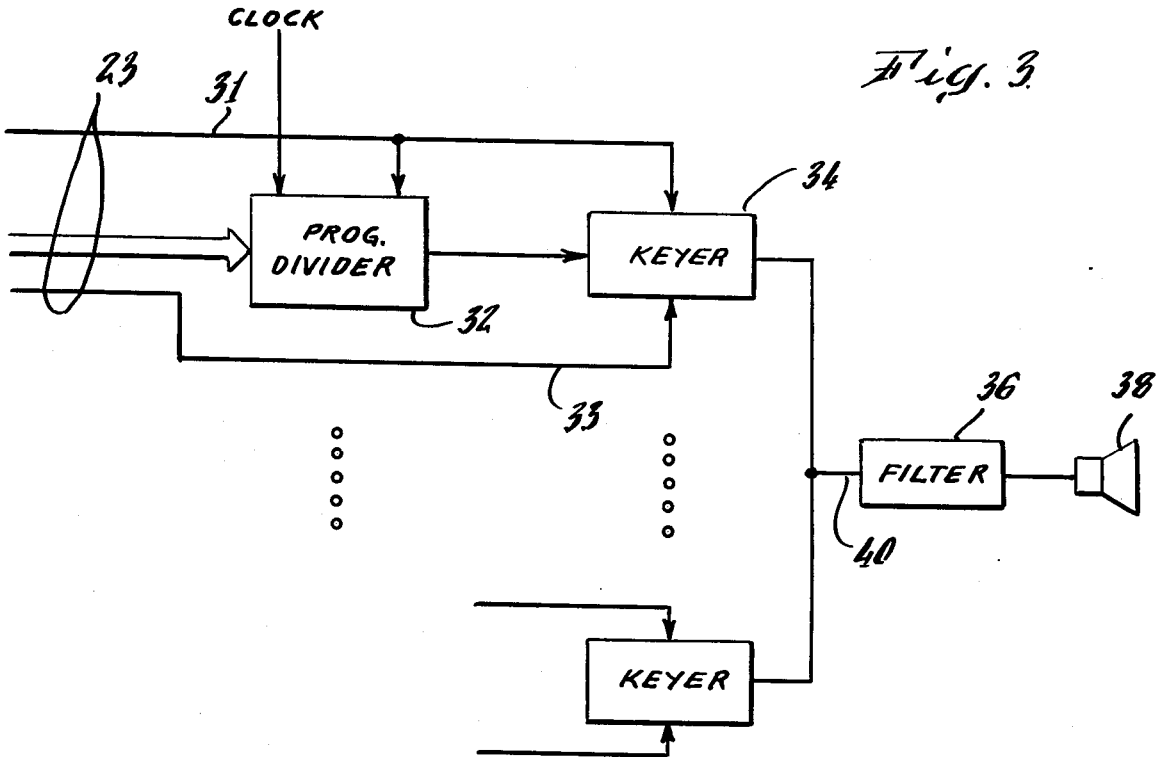
Fig. 3.
Fig. 4.
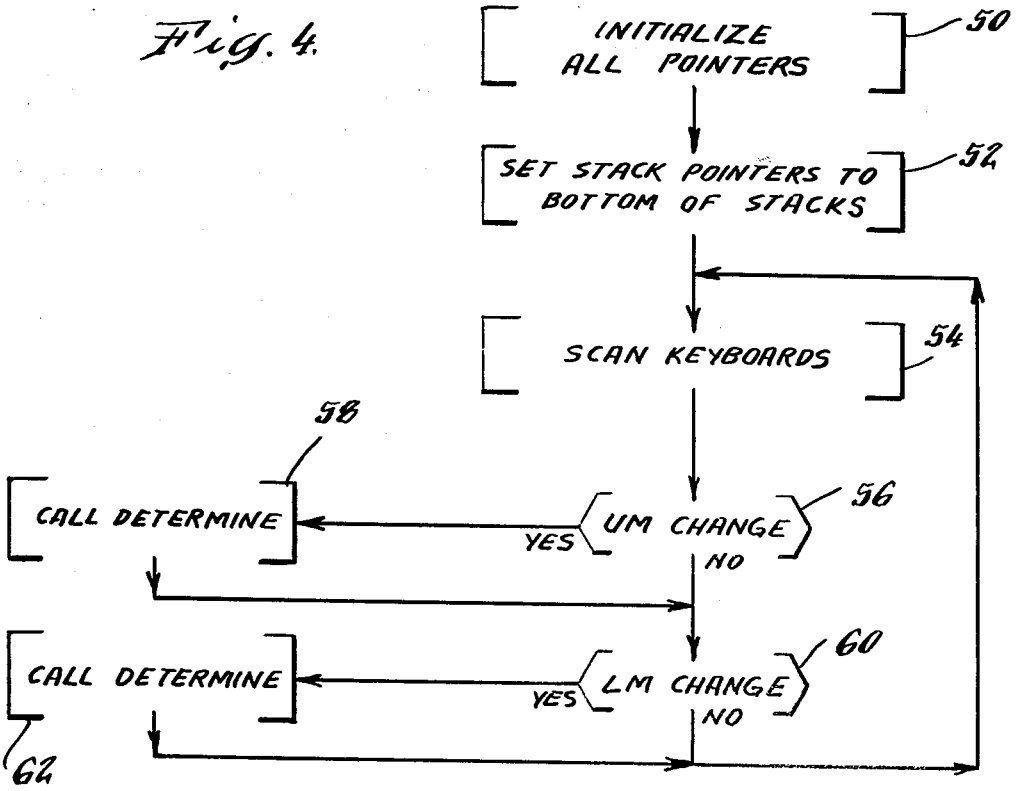

TONE GENERATOR ASSIGNMENT SYSTEM FOR AN ELECTRONIC MUSICAL INSTRUMENT

BACKGROUND OF THE INVENTION

The present invention relates generally to keyboard electronic musical instruments and, more particularly, to a keyboard electronic musical instrument including a plurality of tone generators substantially less in number than the keyboard keys in response to which the tone generators are operated. More specifically, the invention relates to a tone generator assignment system for use in a keyboard electronic musical instrument of the foregoing type.

Keyboard electronic musical instruments such as electronic organs conventionally include one or more keyboard manuals each comprising a plurality of key switches operable for playing a selected musical arrangement. Traditionally, such instruments were designed by providing a separate, dedicated tone generator for each key switch, each of the tone generators being tuned for producing a tone signal having a frequency corresponding in pitch to the note name of the associated key switch. Needless to say, this design philosophy, although successfully followed for a long period of time, resulted in a relatively complex and costly instrument due at least in part to the multiplicity of tone generators.

More recently, keyboard electronic musical instruments have been proposed which utilize a limited number of tone generators substantially less than the keyboard keys in response to which the tone generators are operated. For example, a 44-note keyboard manual may be played through a tone generation system comprising only eight separate tone generators, it being assumed that no more than eight keys of the manual would normally be played at any given time. While drastically reducing the number of required tone generators, this design approach requires that each tone generator be operable for producing a tone signal whose frequency may be adjusted across the entire range of the keyboard manual. That is, each tone generator must be operable for producing a tone signal whose frequency may be varied for reflecting the pitch corresponding to the note name of each key of the keyboard manual. In addition, a system must be provided for assigning the limited number of tone generators to the keys as they are played. In other words, each time a new key is played one of the tone generators must be assigned for producing a tone signal having a frequency corresponding to the pitch of the note name of the played key. This assignment is preferably made in a manner such that minimal adverse effects are noticed in the musical composition being played. In particular, it is desirable that the newly played key assignment does not prematurely cut-off the tone produced in response to a previously played key. For instance, if a particular tone generator has been assigned for producing a tone signal in response to an initially played key, the tone generator should not be assigned to a newly played key until the envelope or amplitude of the tone signal produced in response to the initially played key has decayed to a sufficiently low level. Therefore, even though the initially played key may have been released, the tone generator assigned thereto should not be re-assigned until the envelope of the tone signal has decayed to a level wherein its abrupt cut-off will not be noticed.

In accordance with the foregoing, known tone generator assignment systems typically include circuitry coupled to the output of each tone generator for sensing the level of the envelope of the tone signals produced thereby. After a key has been released, the tone generator previously assigned thereto is rendered available for re-assignment once the level sensing circuitry determines that the envelope of the tone signal produced thereby has decayed to a sufficiently low reference level. This approach therefore requires the use of relatively complex and costly level sensing circuitry and, in addition, is subject to an undesirable lock-out mode of operation. That is, if all available tone generators are producing tone signals characterized by envelope levels above the reference level, a newly played key will not be assigned and thereby ignored even though one or more of the previously played keys have been released.

It is accordingly a basic object of the present invention to provide an improved tone generator assignment system for a keyboard electronic musical instrument of the type having a plurality of multi-frequency tone generators substantially less in number than the keys in response to which the tone generators are operated.

It is a further object of the invention to provide a tone generator assignment system of the foregoing type which implements a novel tone generator assignment technique in a relatively simple and cost effective manner, the novel tone generator assignment technique providing a musically pleasing effect and being characterized by a reduced likelihood of key lock-out.

It is yet another object of the invention to provide a novel tone generator assignment system which is conveniently implemented in a microprocessor based keyboard electronic musical instrument.

SUMMARY OF THE INVENTION

In accordance with these and other useful objects, a novel tone generator assignment system is provided for use in association with a keyboard electronic musical instrument having a plurality of multi-frequency tone generators substantially less in number than the number of keys in response to which the tone generators are operated. According to one aspect of the invention, the assignment system is responsive to the condition wherein all of the tone generators have previously been assigned for operation in response to depressed keys for assigning a newly depressed key to the tone generator which was assigned to the oldest released previously depressed key. According to another aspect of the invention, if the newly depressed key corresponds to one of the previously depressed keys, then the same tone generator is assigned for operation in response to both key depressions. In a preferred embodiment of the invention, the tone generator assignment system is implemented in the form of a microprocessor controlled circuit comprising an assignment memory representing key-tone generator assignments and a stack memory representing the order of key releases.

BRIEF DESCRIPTION OF THE DRAWINGS

The features of this invention which are believed to be novel are set forth with particularity in the appended claims. The invention, together with its objects and the advantages thereof, may best be understood by reference to the following description taken in conjunction with the accompanying drawings in which like reference numerals identify like elements in the several figures and in which:

FIG. 3 is a block diagram showing a typical limited number tone generation system useful with the electronic organ of the invention; and FIGS. 4 and 5 are flow charts showing a preferred technique for programming the program ROM of FIG. 2 in accordance with the invention.

DESCRIPTION OF THE PREFERRED EMBODIMENT

Figure 1:
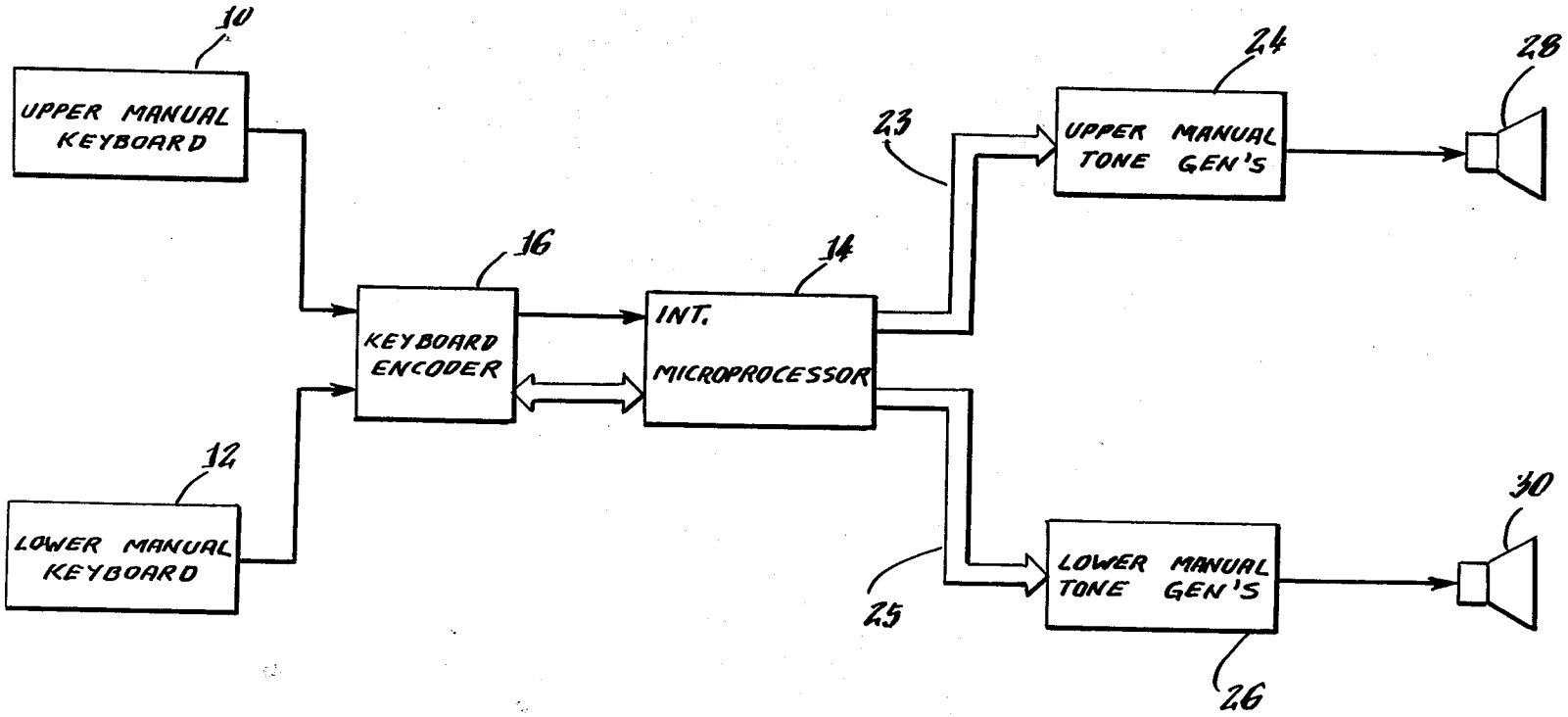
FIG. 1 is a general block diagram showing an electronic organ constructed in accordance with the invention.

Referring now to the drawings and, in particular, to FIG. 1, an electronic musical instrument, such as an electronic organ, constructed according to the invention includes an upper or solo keyboard manual 10 consisting of a plurality of keys defining several octaves of a chromatic musical scale, the keys of keyboard 10 typically being played by the right hand to produce the melody notes associated with a selected musical arrangement. The instrument also includes a lower or accompaniment keyboard manual 12 consisting of a plurality of keys which are typically played by the left hand to produce the accompaniment notes, usually in the form of tonal chords, associated with the selected musical arrangement. While the drawings illustrate the use of two keyboards, 10 and 12, it will be appreciated that the organ may comprise more or less than two keyboards and that other well known apparatus can be used for selecting the notes to be played. Thus, for example, the accompaniment notes may be selected by means of a suitable switch or the like operable for simultaneously selecting a group of notes for playing, which group of notes comprise a desired tonal chord, Returning to FIG. 1, the key switches of upper and lower keyboard manuals 10 and 12 are coupled to the data input of a microprocessor chip 14 through a keyboard encoder 16. Keyboard encoder 16, an exemplary embodiment of which is fully described in copending application Ser. No. 257,488 filed Apr. 24, 1981, now abandoned, assigned to the assignee of the present invention and incorporated herein by reference, cooperates with the key switches of keyboard manuals 10 and 12 for developing a multibit key code uniquely identifying each depressed key switch. That is, for example, assuming that each of the keyboard manuals includes 44 key switches, each of the key switches of the upper keyboard manual 10 may be assigned a unique multibit binary code having a value between 1 and 44 while each key switch of the lower keyboard manual 12 is assigned a unique multibit binary code having a value between 49 and 92. Preferably, in the case of each of the keyboard manuals, the values of the multibit codes are consecutively assigned to the keys with the key representing the highest pitched note on the keyboard being assigned the lowest value multibit code. As fully explained in the foregoing copending application, microprocessor chip 14 couples a scan control signal to keyboard encoder 16 which, in response thereto, repetitively scans the key switches of keyboard manuals 10 and 12. When a depressed key switch is encountered, keyboard encoder 16 couples a control signal to the "Interrupt" input of microprocessor 14 causing the microprocessor to sample the multibit code identifying the depressed key switch which is developed at the output of the keyboard encoder. The sampled multibit code, together with the multibit codes identifying any other depressed key switches, are then stored in the microprocessor chip so as to collectively define the states of keyboard manuals 10 and 12.

Figure 2:
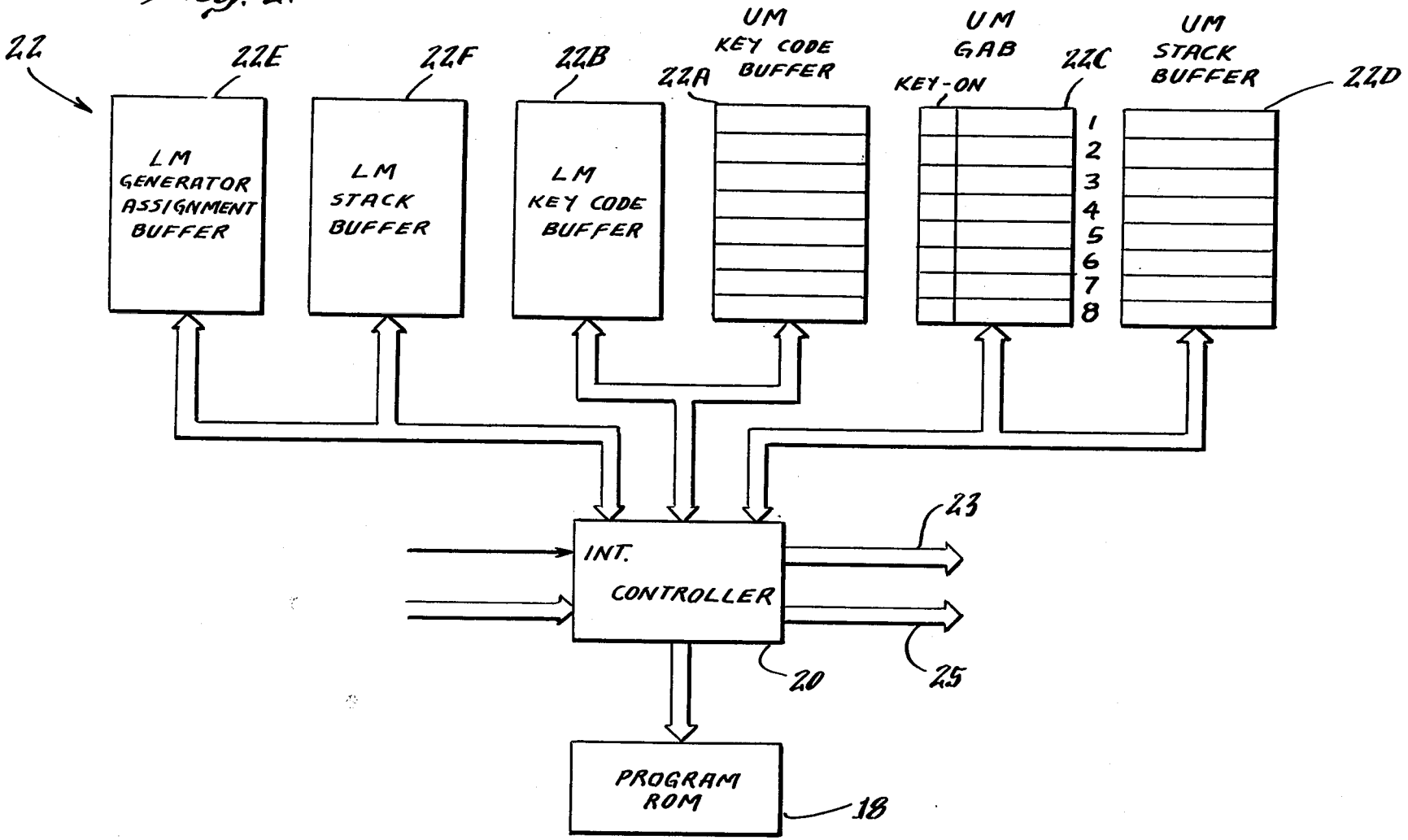
FIG. 2 is a block diagram illustrating the structure of the microprocessor chip shown generally in FIG. 1.

More particularly, and with reference to FIG. 2, microprocessor chip 14 comprises a program ROM 18, a controller 20 and a RAM 22. A microprocessor of this general type is manufactured by Intel Corp. under part No. P 8035 and used in electronic organ Model No. L-65 sold under the "LOWREY" brand name by the Lowrey Organ Co. Controller 20 is operable for sensing the application of an "interrupt" signal from keyboard encoder 16 and, in association with program ROM 18, for coupling the simultaneously developed multibit key code from the keyboard encoder to one of two key code buffer memories of RAM 22. If the supplied multibit key code identifies a depressed key switch of the upper manual 10, i.e. the multibit code has a value between 1 and 44, the code is coupled for storage in an upper manual key code buffer memory 22A of RAM 22 while a multibit code identifying a depressed keyswitch in lower manual 12, i.e. having a value between 49 and 92, is coupled for storage in a lower manual key code buffer memory 22B of RAM 22. Referring back to FIG. 1, as will be explained in further detail hereinafter, program ROM 18 is operable for assigning each multibit code stored in upper manual buffer memory 22A to one of a limited number (e.g. eight) of upper manual tone generators 24 by causing controller 20 to couple the multibit code to the assigned tone generator over an upper manual data bus 23. In a similar manner, program ROM 18 also assigns each multibit code stored in lower manual buffer memory 22B to one of a limited number (e.g. eight) of lower manual tone generators 26 by causing controller 20 to couple the multibit code to the assigned tone generator over a lower manual data bus 25. Each of the upper manual tone generators 24 consequently produces a tone signal corresponding to its assigned multibit code and the depressed upper manual key switch identified thereby, which upper manual tone signals are combined and collectively sounded through a speaker 28. Similarly, each of the lower manual tone generators 26 produces a tone signal corresponding to its assigned multibit code and the depressed lower manual key switch identified thereby, which lower manual tone signals are combined and collectively sounded through a speaker 30. Alternatively, the tone signals produced by the upper and lower manual tone generators 24 and 26 may be combined and sounded through a single speaker.

FIG. 3 illustrates an exemplary one of the upper manual tone generators 24, eight of which are connected in parallel and operated in response to the upper manual data bus 23 as indicated. Each of the tone generators 24 comprises a programmable divider 32 and a keyer 34 both of which are enabled in response to an enabling signal developed by microprocessor 14 on a conductor 31 of the upper manual data bus 23. Microprocessor 14 additionally supplies suitable signals on a conductor 33 of bus 23 for controlling the envelope produced by keyer 34 as well as a multibit key code signal for setting the divisor of programmable divider 32. The output of each keyer 34 is connected through a common voicing filter 36 to speaker 28.

In operation, a tone generator assignment is made by enabling a selected tone generator 24 and supplying the enabled tone generator with appropriate control signals for producing a desired output tone signal. The divisor control signal supplied to programmable divider 32, in particular, reflects the value of the assigned multibit key code such that a tone signal having a corresponding pitch is developed. Thus, each key code stored in upper manual key code buffer 22A is assigned to an individual upper manual tone generator 24 for producing a corresponding output tone signal, the output tone signals being combined on an output conductor 40 for collectively driving speaker 28.

The lower manual tone generators 26 comprise an identical arrangement with each multibit key code stored in lower manual key code buffer 22B being assigned to a lower manual tone generator 26 for producing a corresponding output tone signal, the output tone signals being combined on an output conductor for collectively driving speaker 30.

In accordance with the present invention, key code-tone generator assignments are effected by microprocessor 14 in a manner such that the key code identifying a newly depressed key is assigned to the oldest disabled tone generator for producing a corresponding tone signal. That is, for example, upon sensing the depression of a new key on upper keyboard manual 10, microprocessor 14 implements a routine, hereinafter referred to as DETERMINE, for determining which of the upper manual tone generators 24 was operated in response to the oldest released key of upper keyboard manual 10. The newly played key is then assigned to this tone generator on the assumption that the envelope of the tone signal previously produced thereby will be at a minimum level relative to the envelope of any other tone signals being produced through the upper keyboard manual. In this manner, the possibility of prematurely cutting-off a decaying tone signal is minimized.

In another aspect of the invention, if the newly depressed key corresponds to a key which had previously been depressed and released, and the tone generator to which the key had been assigned has not yet been assigned to a different key, microprocessor 14 is operative for assigning the key code produced in response to the newly depressed key to the same tone generator which had been assigned to the corresponding previously depressed and released key. As a consequence, the tone signals produced in response to the previously depressed and released key and the same newly depressed key are produced by the same tone generator so as to prevent any phase cancellation therebetween.

Referring back to FIG. 2, the DETERMINE routine is implemented by ROM 18 and controller 20 for keys depressed on upper keyboard manual 10 in cooperation with an upper manual generator assignment buffer (GAB) 22C and an upper manual stack buffer 22D. In a similar manner, the DETERMINE routine is implemented by ROM 18 and controller 20 for keys depressed on lower keyboard manual 12 in cooperation with a lower manual generator assignment buffer 22E and a lower manual stack buffer 22F. Each of the buffer memories 22A–22F preferably comprises eight 8-bit memory locations, the number of memory locations corresponding to the eight tone generators available for producing tone signals in response to each of the keyboard manuals 10 and 12. Each memory location of upper manual generator assignment buffer 22C corresponds to a respective one of the upper manual tone generators 24 as indicated by the reference numerals to the right of block 22C. In addition, each memory location of upper manual generator assignment buffer 22C includes a flag bit, hereinafter referred to as a key-on bit, which is coupled by a conductor 31 of bus 23 for controlling its respective tone generator 24. A logical 1 key-on bit stored at a memory location of the generator assignment buffer represents an enabling signal for the associated tone generator 24 while a logical 0 key-on bit represents a disabling signal. Thus, when a memory location of the generator assignment buffer includes a key-code and a logical 1 key-on bit the respective tone generator 24 is both enabled and programmed for producing a tone signal having a frequency corresponding to the stored key code. A memory location characterized by a logical 0 key-on bit results in the associated tone generator 24 being disabled although the tone generator may nevertheless be producing a decaying tone signal corresponding in frequency to a stored key code representing a key which had been depressed but which was recently released.

The eight memory locations of upper manual stack buffer 22D are used to track key releases. As will be explained in detail hereinafter, the upper manual tone generators 24 assigned to keys which have been released are entered as of the time of their release at the top of the stack buffer. As a consequence, the tone generators identified at the bottom of the stack buffer represent the oldest released keys which are assigned to the key codes representing newly depressed keys. Since the lower manual buffers are configured and operate in an identical manner in cooperation with the lower manual tone generators 26 they will not be described in detail.

The main operational program stored in ROM 18 is illustrated in flow chart form in FIG. 4. Upon initially applying power to the instrument, an instruction 50 initializes all buffer pointers and an instruction 52 sets the pointers of stack buffers 22D and 22F to the bottom of each respective stack. An instruction 54 then causes the keyboards to be scanned and a decision 56 is made as to whether there is a change in the status of upper keyboard manual 10; i.e., whether any keys have been depressed which were not depressed during the preceding keyboard scan. If a new key depression is detected, represented by the storage of the corresponding key code in upper manual key code buffer 22A, an instruction 58 calls subroutine DETERMINE. This subroutine assigns the key code representing the newly depressed key to the tone generator 24 previously assigned to the key code representing the oldest previously released upper manual key. If, however, the newly depressed key is the same as a previously depressed and released key whose key code is stored in generator assignment buffer 22C, then the newly depressed key is assigned to the same tone generator 24 as was the previously depressed key.

After the key code-tone generator assignment has been made for the newly depressed upper manual key, a decision 60 is made detecting any newly depressed lower manual keys. If there are no newly depressed lower manual keys the routine returns to instruction 54 for re-scanning the keyboards. If, however, a newly depressed lower manual key is detected, an instruction 62 call subroutine DETERMINE for assigning the corresponding key code stored in lower manual key code buffer 22B to one of the lower manual tone generators 26 as described above. Thereafter, the routine is returned to instruction 54 for rescanning the keyboards.

Figure 5:
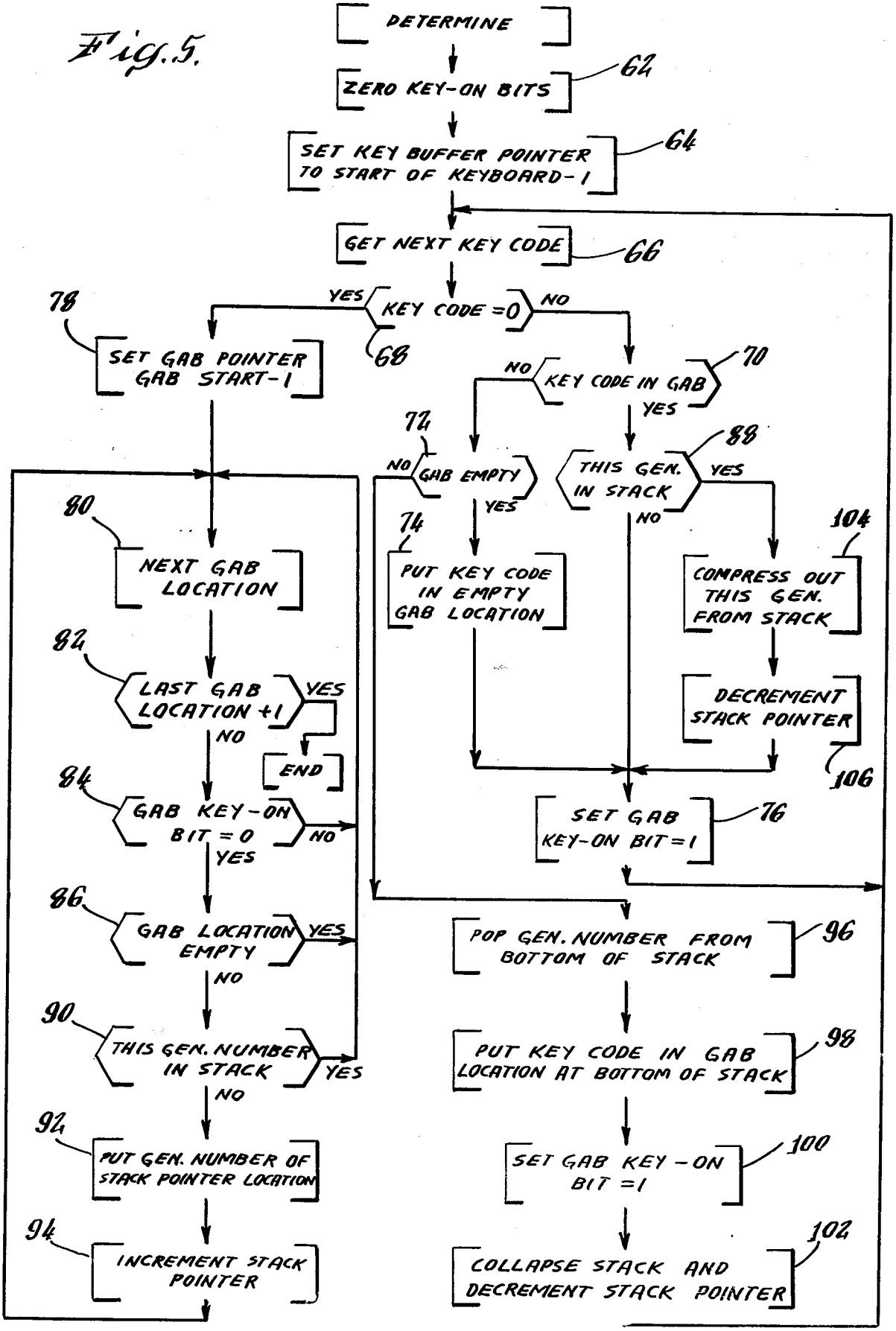

FIG. 5 illustrates the DETERMINE subroutine in flow chart form. To facilitate an understanding of the operation of this subroutine assume that power has been applied to the instrument and that a single upper manual key has been depressed. Since there is a change in the status of the upper manual keys, no key depressions to a single key depression, subroutine DETERMINE is called in response to instruction 58 of the flow chart of FIG. 4.

Referring to the DETERMINE subroutine, an instruction 62 initially sets each of the key-on bits of upper manual generator assignment buffer to zero. An instruction 64 then sets the pointer of key code buffer 22A to a value one unit prior to its starting address location. Next, in accordance with an instruction 66, the key code stored at the starting key code buffer address (corresponding to the single depressed upper manual key) is fetched and tested by a decision 68 to determine whether its value is zero. Since key codes are consecutively stored in key code buffer 22A beginning with the starting memory address location, a zero value key code indicates that there are no further key codes stored in the buffer. In the present example, a non-zero value key code (corresponding to the single depressed key) is stored in key code buffer starting address location so that decision 68 is answered in the negative. Next, a decision 70 is made regarding whether the fetched key code is already stored at a memory location in generator assignment buffer 22C. Since it is not, a NO decision is made and a test 72 is performed to determine whether there is any empty memory location in generator assignment buffer 22C. Since there is an empty memory location, the fetched key code is stored in the empty memory location in accordance with an instruction 74 and the key-on bit of the memory location is set to logical 1 in accordance with an instruction 76. As a consequence, the tone generator 24 (for example tone generator number 1) associated with the memory location is assigned for producing a tone signal according to the stored key code.

The subroutine now returns to instruction 66 and the key code stored at the next consecutive memory location is fetched. Since this key code has a zero value (no other key codes being stored in key code buffer 22A), an affirmative answer results from decision 68 and an instruction 78 is executed setting the pointer of generator assignment buffer 22C to a value one unit prior to its starting or top address location. The next or starting generator assignment buffer address is then fetched in accordance with an instruction 80 and a decision 82 is made to determine whether it is one unit greater than the last generator assignment buffer address. Decision 82 yields a NO response requiring another decision 84 to determine whether the key-on bit of the fetched generator assignment buffer location is 0. Since this key-on bit had previously been set to 1 a NO results returning the routine to instruction 80. Instruction 80 fetches the next generator assignment buffer memory location and decision 82 is repeated reaching another NO answer. Decision 84 is next repeated but now reaches a YES answer since the key-on bit for the second generator assignment buffer memory location had not been set to 1. A decision 86 is consequently executed to determine whether the fetched generator assignment buffer memory location is empty. Since this memory location is empty the subroutine is returned to instruction 80. The loop comprising blocks 80, 82, 84 and 86 is successively repeated for each subsequent generator assignment buffer memory location until a YES answer is finally reached by decision 82 ending the subroutine.

If another key is subsequently depressed on upper keyboard manual 10 an identical procedure is followed as a result of which the associated key code is stored in another memory location of generator assignment buffer 22C together with a logical 1 key-on bit. This stored key-code is then assigned to the tone generator 24 (e.g. tone generator number 2) associated with the corresponding generator assignment buffer memory location. In this manner, the key-codes associated with up to eight depressed keys can be stored in generator assignment buffer 22C, each being assigned to a respective tone generator 24.

Assume now that one of the depressed upper manual keys is released. The DETERMINE subroutine is consequently called by instruction 58 since there has been a change in the status or condition of upper keyboard manual 10. As a result, the key-on bits of each memory location of generator assignment buffer 22C is set to 0 and the key code buffer poiner is set in accordance with instructions 62 and 64 respectively. Thereafter, the loop consisting of blocks 66, 68, 70, 88, 76 and 66 is repeated for each key-code stored in generator assignment buffer 22C corresponding to a depressed key which was not released, the key-on bit associated with each of these key codes being set to logical 1 by instruction 76. Each unreleased key consequently remains assigned to the same tone generator 24. Decision 88 requires a determination as to whether the tone generator number (i.e., 1–8) associated with the current generator assignment buffer memory location is stored in stack buffer 22D. In the present example, a NO answer is reached in response to this decision for each unreleased key.

Since the released upper manual key does not result in a key code being stored in key code buffer 22A, a YES answer is reached by decision 68 when this key code buffer address location is fetched by instruction 66. After setting the generator assignment buffer pointer in accordance with instruction 78, the loop consisting of blocks 80, 82, 84 and 86 is executed for each generator assignment buffer memory location storing a key code corresponding to an unreleased key. The generator assignment buffer memory location storing the key code corresponding to the released key will be associated with a logical 0 key-on bit so that an exit from the foregoing loop is made when this generator assignment buffer memory location is interrogated by decision 84. The exit leads directly to decision 86 which is answered negatively since the generator assignment buffer memory location is still storing the key code corresponding to the released key. As a result, a determination is made as to whether the identifying number of the tone generator 24 corresponding to this generator assignment buffer memory location is stored in stack buffer 22D in accordance with a decision 90. Since, in the present example, stack buffer 22D is empty a NO answer is reached and an instruction 92 is executed putting the tone generator identification number at the stack buffer memory location identified by its pointer. Since the pointer had been previously initialized at the bottom of stack buffer 22D, (see instruction 52) the tone generator identification number (identifying the tone generator 24 previously assigned to the released key) is stored at the bottom memory location of stack buffer 22D. The stack buffer pointer is then incremented one unit to the penultimate stack buffer memory location in accordance with an instruction 94 and the subroutine is returned to instruction 80. Had the tone generator identification number identifying the tone generator 24 previously assigned to the released key already been stored in stack buffer 22D, it would not be stored a second time but rather the subroutine would return to instruction 80 by reaching a YES answer from decision 90.

As additional depressed keys are released, identification numbers of the tone generators 24 previously assigned thereto are stored in stack buffer 22D in a similar manner. Thus, the identification numbers of the tone generators 24 associated with key codes corresponding to released keys are stored in stack buffer 22D in reverse order of their release. That is, the identification number of the tone generator associated with the oldest released key is stored at the bottom memory location of stack buffer 22D, the identification number of the tone generator associated with the second oldest released key at the penultimate memory location and so on, with the identification number of the tone generator associated with the most recent released key being stored at the highest non-zero valued memory location of stack buffer 22D. Also, it will be appreciated that, as a result of instruction 94, the stack buffer pointer will be one memory location above this highest non-zero value memory location.

Now, on some subsequent keyboard scan, assume that a new upper manual key is depressed. The DETERMINE subroutine is called in response to instruction 58. At some point, the key code buffer memory location storing the key code corresponding to the newly depressed key is fetched in accordance with instruction 66 and a NO answer is reached in response to decision 68. If the new key code is not stored in generator assignment buffer 22C (indicating that the key had not been previously depressed and released) a NO answer results from decision 70. In accordance with decision 72, if there is an empty memory location in generator assignment buffer 22C the new key code will be stored at the empty memory location in accordance with instruction 74 and its key-on bit will be set to logical 1 by instruction 76 effecting the assignment of the new key code to the tone generator 24 corresponding to the empty generator assignment buffer memory location.

If there were no empty memory locations in generator assignment buffer 22C, a NO answer results from decision 72 and an instruction 96 is executed. Instruction 96 requires that the identification number of the tone generator 24 stored at the bottom memory location of stack buffer 22D (i.e. corresponding to the oldest released key) be removed and that, in accordance with an instruction 98, the key code associated with the newly depressed key be stored in the memory location of generator assignment buffer 22C corresponding to the removed or popped tone generator identification number, the associated key-on bit being set to logical 1 in response to a subsequent instruction 100. As a result, the key code associated with the newly depressed key is assigned to the tone generator 24 previously assigned to the key code associated with the oldest released key as desired. Thereafter, the contents of stack buffer 22D are collapsed and the stack buffer pointer is decremented in accordance with an instruction 102 to facilitate re-execution of the foregoing procedure. The subroutine is then returned to instruction 66.

Returning to decision 70, a YES answer results if the key code corresponding to the newly depressed key is already stored at a memory location of generator assignment buffer 22C, indicating that the newly depressed key had previously been depressed. As a result, decision 88 is executed to determine whether the tone generator identification number corresponding to this memory location is also stored in stack buffer 22D. If it is not a NO answer results. If the tone generator identification number is stored in stack buffer 22D, then an instruction 104 is executed compressing the generator identification number out from stack buffer 22D and the stack pointer is decremented in accordance with an instruction 106. In either case, the key-on bit of this generator assignment buffer memory location is set to logical 1 by instruction 76 so that the key code associated with the newly depressed key is assigned to the same tone generator 24 which was previously assigned to the same key code. The foregoing prevents the possibility of phase cancellation where the outputs of two tone generators operated at the same frequencies are combined. Instructions 104 and 106 are included to remove the identification number of the re-assigned tone generator from stack buffer 22D since it no longer represents a previously released key.

What has thus been shown is an improved tone generator assignment system implemented by a microprocessor such that a newly depressed key is assigned on a priority basis to a tone generator which had previously been assigned to the oldest depressed and released key. In addition, if a key is depressed, released and depressed again, the same tone generator will be assigned to the key in response to both key depressions if that tone generator had not subsequently been assigned to a different key.

While a particular embodiment of the invention has been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

What is claimed is:

1. An electronic musical instrument comprising:

a keyboard having a plurality of playable keys each representing the pitch of a different musical note;

encoding means developing a multibit code uniquely identifying each depressed key of said keyboard;

a plurality of tone generator means substantially less in number than the number of keys characterizing said keyboard, each of said tone generator means being operable in response to each of said multibit codes for producing a tone signal having a frequency corresponding to the pitch of the associated key; and control means responsive to the condition wherein all of said tone generator means have been previously assigned for operation in response to one of said multibit codes for assigning a newly developed one of said multibit codes for operating the one of said tone generator means previously assigned for operation in response to the multibit code representing the oldest released one of said keys.

2. The electronic musical instrument of claim 1 wherein said control means comprises means for assigning, on a priority basis, a newly developed one of said multibit codes for operating the one of said tone generator means previously operated in response to the identical one of said multibit codes.

3. The electronic musical instrument of claim 1 wherein said control means comprises an assignment memory having a unique memory location corresponding to each respective one of said tone generator means, each memory location of said assignment memory being adapted for storing one of said multibit codes together with a flag bit, the state of said flag bit representing whether the corresponding tone generator means is enabled for producing a tone signal in accordance with the associated multibit code.

4. The electronic musical instrument of claim 3 wherein said control means comprises a stack memory having at least as many memory locations as said assignment memory, each memory location of said stack memory being adapted for storing an address code identifying each respective memory location of said assignment memory and its corresponding tone generator means.

5. The electronic musical instrument of claim 4 wherein said control means comprises means for storing each newly developed one of said multibit codes in a respective memory location of said assignment memory together with an associated flag bit characterized by a tone generator means enabling state until all of the memory locations of said assignment memory have been filled.

6. The electronic musical instrument of claim 5 wherein said control means comprises means for storing the address code identifying the memory location of said assignment memory storing a multibit code corresponding to a released key at the zero-value memory location closest to one end of said stack memory.

7. The electronic musical instrument of claim 6 wherein said control means comprises means for storing a newly developed one of said multibit codes at the memory location of said assignment memory identified by the address code stored in the memory location of said stack memory located at said one end thereof when said assignment memory is in a completely filled condition, each address code stored in said stack memory being thereafter shifted one memory location toward said one end of said stack memory.

8. An electronic musical instrument comprising:

a keyboard having a plurality of playable keys each representing the pitch of a different musical note;

encoding means developing a multibit code uniquely identifying each depressed key of said keyboard;

a plurality of tone generator means substantially less in number than the number of keys characterizing said keyboard, each of said tone generator means being operable in response to each of said multibit codes for producing a tone signal having a frequency corresponding to the pitch of the associated key;

an assignment memory having a unique memory location corresponding to each respective one of said tone generator means adapted for storing one of said multibit codes together with a flat bit representing whether the corresponding tone generator means is enabled for producing a tone signal in accordance with the associated stored multibit code;

a stack memory having a plurality of memory locations each adapted for storing an address code identifying each respective memory location of said assignment memory; and control means for storing each newly developed multibit code in a respective memory location of said assignment memory together with an associated flag bit characterized by a tone generator means enabling state and for storing the address code identifying the memory location of said assignment memory storing a multibit code corresponding to a released key at the zero-value memory location closest to one end of said stack memory, said control means further comprising means for storing a newly developed one of said multibit codes at the memory location of said assignment memory identified by the address code stored in the memory location of said stack memory located at said one end thereof when said assignment memory is in a completely filled condition, each address code stored in said stack memory being thereafter shifted one memory location toward said one end of said stack memory.

9. In a keyboard electronic musical instrument of the type having a plurality of multi-frequency tone generators substantially less in number than the number of keys of said keyboard, the method of assigning said tone generators for operation in response to depressed ones of said keys comprising:

assigning a different one of said tone generators for operation in response to a newly depressed key until all of said tone generators have been so assigned;

identify the tone generators assigned to released ones of said keys in a time ordered sequence; and re-assigning the tone generator assigned to the oldest released key identified by said time ordered sequence for operation in response to a subsequently depressed key.

10. The method of claim 9 including the step of deleting said re-assigned tone generator from said time ordered sequence.

11. In a keyboard electronic musical instrument of the type having a plurality of multi-frequency tone generators substantially less in number than the number of keys of said keyboard, the method of assigning said tone generators for operation in response to depressed ones of said keys comprising:

assigning a different one of said tone generators for operation in response to a newly depressed key until all of said tone generators have been so assigned;

identifying the tone generators assigned to released ones of said keys in a time ordered sequence;

re-assigning the tone generator assigned for operation in response to one of said newly depressed keys for operation in response to a subsequent depression of the same key; and, otherwise re-assigning the tone generator assigned to the oldest released key identified by said time ordered sequence for operation in response to a subsequently depressed key.

12. The method of claim 11 including the step of deleting said re-assigned tone generator from said time ordered sequence.

* * * * *